US008749437B2

(12) United States Patent
Bai et al.

(10) Patent No.: US 8,749,437 B2
(45) Date of Patent: Jun. 10, 2014

(54) MOBILE COMMUNICATION TERMINAL

(75) Inventors: Jian Bai, Huizhou (CN); Yufei Tang, Huizhou (CN); Xin Jin, Huizhou (CN)

(73) Assignee: Huizhou TCL Mobile Communication Co., Ltd, Huizhou, Guangdong (CN)

( * ) Notice: Subject to any disclaimer, the term of this patent is extended or adjusted under 35 U.S.C. 154(b) by 438 days.

(21) Appl. No.: 13/203,881

(22) PCT Filed: Apr. 22, 2010

(86) PCT No.: PCT/CN2010/072037

§ 371 (c)(1),
(2), (4) Date: Aug. 30, 2011

(87) PCT Pub. No.: WO2011/003293

PCT Pub. Date: Jan. 13, 2011

(65) Prior Publication Data

US 2011/0316749 A1 Dec. 29, 2011

(30) Foreign Application Priority Data

Jul. 7, 2009 (CN) ..... 2009 1 0108490

(51) Int. Cl.
*H01Q 1/24* (2006.01)

(52) U.S. Cl.
USPC ..... 343/702; 343/700 MS

(58) Field of Classification Search
USPC ..... 343/700, 702, 767, 846, 848, 770
See application file for complete search history.

(56) References Cited

U.S. PATENT DOCUMENTS

2004/0239575 A1* 12/2004 Shoji et al. ..... 343/770
2008/0084355 A1* 4/2008 Kuraoka et al. ..... 343/702
2010/0238072 A1* 9/2010 Ayatollahi et al. ..... 343/700 MS

FOREIGN PATENT DOCUMENTS

CN 200941612 Y 8/2007

* cited by examiner

*Primary Examiner* — Tho G Phan
(74) *Attorney, Agent, or Firm* — Shimokaji & Associates P.C.

(57) ABSTRACT

A mobile communication terminal comprises a motherboard and an internal antenna that is arranged at one end of the motherboard, and an isolation structure similar a hairline crack is formed at the other end of the motherboard far from the internal antenna. The mobile communication terminal provided by the present invention extends the main ground length of an antenna by means of an isolation structure on a motherboard, thereby increasing the antenna bandwidth so as to meet radio-frequency performance requirements.

18 Claims, 2 Drawing Sheets

MOBILE COMMUNICATION TERMINAL

TECHNICAL FIELD

The present invention relates to the field of mobile communication terminals and more specifically, to an antenna technology for small mobile communication terminals.

BACKGROUND OF THE INVENTION

Due to popular consumer demand, there is a trend to develop smaller mobile terminals, such as cell phones, which makes more and more mobile terminals use internal antennas. On one hand, the bandwidth of regular internal antennas for mobile terminals (in particular antennas working at low frequency bands of 850 MHz/900 MHz) is dependent on the antennas and clearance, and the motherboard length (i.e. the main ground length of antennas) is also an important factor determining the antenna bandwidth. On the other hand, fierce market competition makes customer experience increasingly important, while the antenna performance of a mobile terminal directly determines a customer's experience. At the same time, there are more and more high-speed data services on mobile networks, all of which require that mobile terminals have excellent antenna performance. That is because, under the same wireless network environment, mobile terminals with better antenna performance can use modulation methods with higher speed, which can optimize customer experience and moreover, can improve network utilization rate and save resources. Therefore, the design of high performance and wide bandwidth antennas inside small mobile terminals has become a hot research topic in the industry. Particularly in the current antenna design for mobile terminals, low frequency band antennas require motherboard lengths to exceed 100 mm; otherwise it would be difficult to achieve sufficient bandwidth. In practical development, however, some small terminals are unable to meet the above condition, which makes it difficult to develop antennas. For example, FIG. 1 shows a PIFA antenna emulation on a motherboard with the size of 62 mm*100 mm*1 mm (length*width*height), the antenna has a height of 9 mm and is a GSM850/PCS dual frequency antenna. The emulation performance of the antenna is shown in FIG. 1. From the emulation result, the antenna can substantially meet performance requirements at frequency bands of GSM850 and PCS. If the size of this motherboard is revised to 62 mm*62 mm*1 mm (to meet miniaturization requirements for mobile terminals) and the antenna size is adjusted and optimized, the new antenna structure and emulation result are shown in FIG. 2. It can be seen from the emulation result in FIG. 2 that in frequency bands of the high frequency PCS, the impact of motherboard length on the antenna's performance is relatively small and the antenna's performance can substantially meet requirements. In the frequency bands of the low frequency GSM850, however, the antenna bandwidth deteriorates rapidly, which is unable to meet the requirement for radio-frequency performance. Therefore, the miniaturization of mobile terminals results in significant negative impacts on the antenna's bandwidth performance. As a result, it is indeed necessary to provide a technology for strengthening the performance of internal antennas of small mobile terminals.

SUMMARY OF THE INVENTION

Technical Problem

The object of the present invention is to provide a mobile communication terminal so as to overcome the drawback of poor bandwidth performance of internal antennas in the prior art.

Technical Solution

The mobile communication terminal provided by an embodiment of present invention comprises a motherboard comprising a main substrate; an internal antenna arranged on the main substrate and adjacent to a first end thereof; and an isolating structure formed on the main substrate and adjacent to a second end thereof, the second end being opposite to the first end.

More specifically, the isolating structure is formed by two groups which extend from opposite sides of the main substrate into a middle thereof and form two comb structures on the main substrate.

More specifically, each of the two groups is formed by one or more cracks, wherein the cracks belong respectively to the two groups and the cracks alternate between the two groups along the second end of the main substrate.

More specifically, the cracks are parallel to each other.

More specifically, the cracks are hairline cracks.

More specifically, the cracks are round grooves.

More specifically, the cracks have a width of 1 mm and a space between each two adjacent cracks is 3 mm.

More specifically, the main substrate has a length smaller than 100 mm.

More specifically, the main substrate has a size of 62 mm*62 mm*1 mm.

The mobile communication terminal provided by another embodiment of present invention comprises a motherboard adapted for a mobile communication terminal, the motherboard comprising a main substrate; an internal antenna arranged on the main substrate and adjacent to a first end thereof; and an isolating structure formed on the main substrate and adjacent to a second end thereof, the second end being opposite to the first end.

More specifically, the isolating structure is formed by two groups which extend from opposite sides of the main substrate into a middle thereof and form two comb structures on the main substrate.

More specifically, each of the two groups is formed by one or more cracks, wherein the cracks belong respectively to the two groups and the cracks alternate between the two groups along the second end of the main substrate.

More specifically, the cracks are parallel to each other.

More specifically, the cracks are hairline cracks.

More specifically, the cracks are round grooves.

More specifically, the cracks have a width of 1 mm, and a space between each two adjacent cracks is 3 mm.

More specifically, the main substrate has a length smaller than 100 mm.

More specifically, the main substrate has a size of 62 mm*62 mm*1 mm.

The mobile communication terminal provided by another embodiment of present invention comprises a motherboard comprising a main substrate; an internal antenna arranged on the main substrate and adjacent to a first end of the motherboard; a first set of cracks extending from a first side of the motherboard, on a second end of the motherboard, the second end being opposite to the first end; and a second set of cracks extending from a second side of the motherboard, on the second end of the motherboard, the second side being opposite the first side.

More specifically, the cracks are hairline cracks parallel to each other; and the cracks have a width of 1 mm, and a space between each two adjacent cracks is 3 mm.

Advantageous Effects

The mobile communication terminal provided by the present invention extends the main ground length of an antenna by means of an isolation structure on a motherboard, thereby improving the antenna bandwidth so as to meet requirements of antenna radio-frequency performance, and at the same time, changing the radiation model of a mobile terminal and consequently improving SAR and HAC values.

DETAILED DESCRIPTION OF THE INVENTION

To make the object, technical solution and advantages of the present invention clearer, the present invention is further described in detail below with reference to the accompanying drawings and embodiment. It should be understood that the embodiment described herein is used only to describe the present invention with no intention to limit the present invention in any way.

Figure 1:
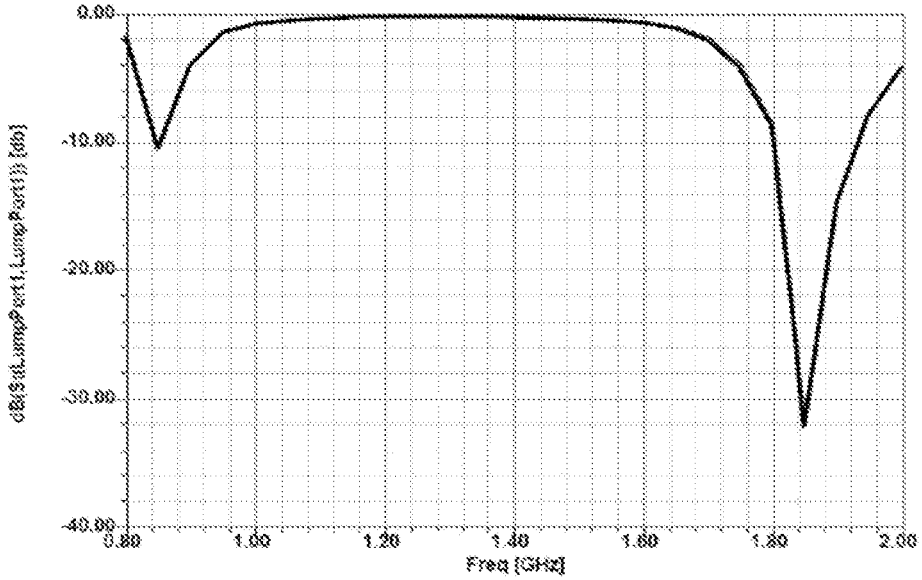
FIG. 1 (Prior Art)
FIG. 1 shows emulation of a PIFA antenna of a mobile terminal with a 100 mm wide motherboard according to the prior art.
Figure 2:
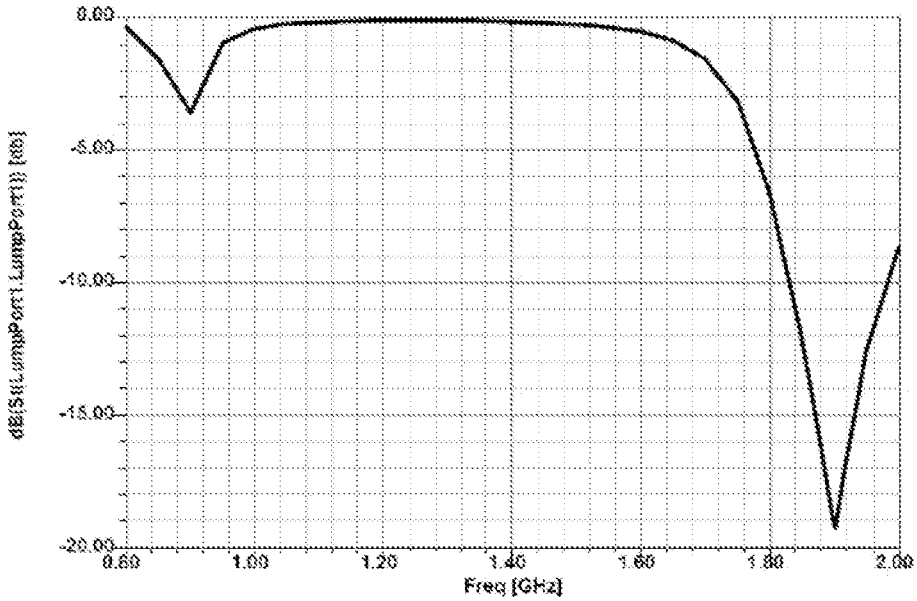
FIG. 2 (Prior Art)
FIG. 2 shows emulation of a PIFA antenna of a mobile terminal with a 62 mm wide motherboard according to the prior art.
Figure 3:
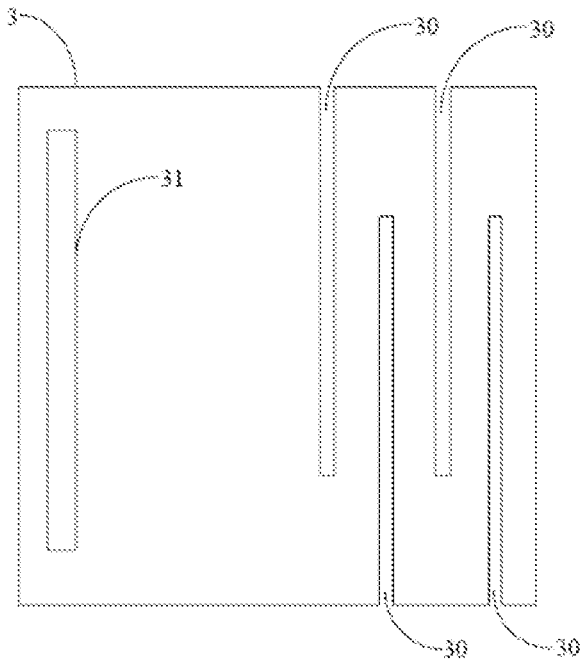
FIG. 3 illustrates the structure of a mobile communication terminal according to the present invention.
Figure 4:
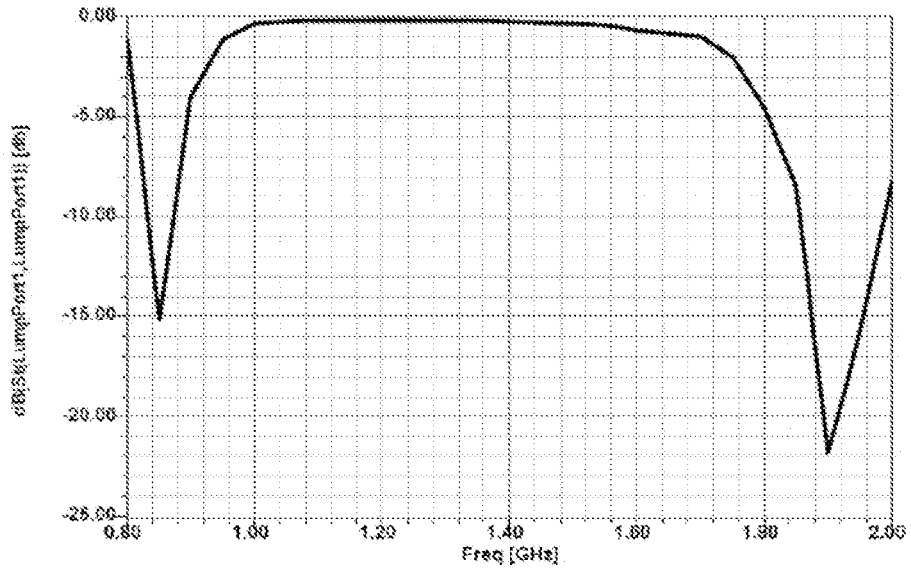
FIG. 4 shows emulation of a PIFA antenna of a mobile terminal with a 62 mm wide motherboard according to the present invention.

The mobile communication terminal provided by the present invention extends the main ground length to strengthen antenna bandwidth by means of modifying the shape and structure of a motherboard. In an embodiment shown in FIG. 3, the mobile communication terminal provided by the present invention comprises a motherboard 3 and an internal antenna 31 that is arranged at one end of the motherboard 3, and four hairline cracks 30 are formed at the other. end of the motherboard 3 far from the internal antenna 31 such that the main ground length formed by the motherboard 3 is extended. As shown in FIG. 4, when a 62 mm×62 mm×1 mm motherboard adopts the structure in FIG. 3 (the hairline crack 30 has a width of 1 mm, length of 52 mm, and spacing of 3 mm), according to the emulation result, the newly added hairline cracks 30 are capable of greatly improving the antenna bandwidth at low frequencies and increasing the antenna's return loss.

With the adoption of the above structure according to the present invention, at the same time, a mobile terminal's radiation model can be changed as well, namely, the radiation hot spot distribution of a mobile terminal can be changed. Therefore, the terminal's SAR (Specific Absorption Rate) value and the field distribution of HAC (Hearing Aid Compatibility) can be adjusted. Specifically, the terminal's radiation hot spots are moved to positions with fewer contributions to SAR and HAC, which consequently improves the SAR and HAC values.

In summary, the mobile communication terminal provided by the present invention extends the main ground length of an antenna by means of an isolation structure (a structure that can be a plurality of hairline cracks 30 as described in the above preferred embodiment, but is not limited to cracks) on a motherboard, thereby increasing the antenna's main ground length to subsequently improve antenna bandwidth for meeting radio-frequency performance requirements.

Only one embodiment of the present invention is described above with no intention to limit the present invention. For example, the isolation structure can be parallel hairline cracks as described in the above preferred embodiment, but can also be arc-shaped round grooves and the like. Any modification, equivalent replacement and improvement made within the spirit and principle of the present invention shall be encompassed in the scope defined by claims herein.

The invention claimed is:

1. A mobile communication terminal comprising:
- a motherboard comprising:
  - a main substrate:
  - an internal antenna arranged on the main substrate and adjacent to a first end thereof; and
  - an isolating structure formed on the main substrate and adjacent to a second end thereof, the second end being opposite to the first end,
  - wherein the isolating structure is formed by two groups which extend from opposite sides of the main substrate into an area between the opposite sides, and the two groups form two comb structures on the main substrate.

2. The mobile communication terminal of claim 1, wherein each of the two groups is formed by one or more cracks, wherein the cracks belong respectively to the two groups and the cracks alternate between the two groups along the second end of the main substrate.

3. The mobile communication terminal of claim 2, wherein the cracks are parallel to each other.

4. The mobile communication terminal of claim 2, wherein the cracks are hairline cracks.

5. The mobile communication terminal of claim 2, wherein the cracks are round grooves.

6. The mobile communication terminal of claim 2, wherein the cracks have a width of 1 mm and a space between each two adjacent cracks is 3 mm.

7. The mobile communication terminal of claim 1, wherein the main substrate has a length smaller than 100 mm.

8. The mobile communication terminal of claim 1, wherein the main substrate has a size of 62 mm*62 mm*1 mm.

9. A motherboard adapted for a small mobile communication terminal, comprising:
- a main substrate;
- an internal antenna arranged on the main substrate and adjacent to a first end thereof; and
- an isolating structure formed on the main substrate and adjacent to a second end thereof, the second end being opposite to the first end,
- wherein the isolating structure is formed by two groups and the two groups are each formed by one or more cracks, and
- wherein the cracks alternate between the two groups along the second end of the main substrate.

10. The motherboard of claim 9, wherein the two groups extend from opposite sides of the main substrate into an area between the opposite sides and form two comb structures on the main substrate.

11. The motherboard of claim 9, wherein the cracks are parallel to each other.

12. The motherboard of claim 9, wherein the cracks are hairline cracks.

13. The motherboard of claim 9, wherein the cracks are round grooves.

14. The motherboard of claim 9, wherein the cracks have a width of 1 mm, and a space between each two adjacent cracks is 3 mm.

15. The motherboard of claim 9, wherein the main substrate has a length smaller than 100 mm.

16. The motherboard of claim 9, wherein the main substrate has a size of 62 mm*62 mm*1 mm.

17. A mobile communication terminal, comprising:

a motherboard comprising a main substrate;

an internal antenna arranged on the main substrate and adjacent to a first end of the motherboard;

a first set of cracks extending from a first side of the motherboard, on a second end of the motherboard, the second end being opposite to the first end; and a second set of cracks extending from a second side of the motherboard, on the second end of the motherboard, the second side being opposite the first side.

18. The mobile communication terminal of claim 17, wherein:

the cracks are hairline cracks parallel to each other; and the cracks have a width of 1 mm, and a space between each two adjacent cracks is 3 mm.

* * * * *